United States Patent [19]

Hurner

[11] Patent Number: 4,573,610

[45] Date of Patent: Mar. 4, 1986

[54] GOLF TEE DISPENSER

[76] Inventor: Erwin E. Hurner, 2605 S. Rivershore Dr., Moorhead, Minn. 56560

[21] Appl. No.: 625,661

[22] Filed: Jun. 28, 1984

[51] Int. Cl.[4] ..... B65G 59/06

[52] U.S. Cl. ..... 221/281; 224/918

[58] Field of Search ..... 221/307, 309, 310, 281; 224/918; 273/32 D

[56] References Cited

U.S. PATENT DOCUMENTS 2,771,216 11/1956 Reiner ..... 221/307 X 3,892,334 7/1975 Hand et al. ..... 221/307 X

*Primary Examiner*—Stanley H. Tollberg

*Attorney, Agent, or Firm*—Bailey & Hardaway

[57] ABSTRACT

A container and dispenser for golf tees which is formed of a tube having a cylindrical opening through the center thereof for housing a plurality of golf tees one atop the other. The tube has attached at one end thereof an elastomeric nipple having an orifice therethrough for dispensing the tees. The tube is additionally provided with an opening for loading tees into the cylindrical opening thereof.

2 Claims, 3 Drawing Figures

GOLF TEE DISPENSER

BACKGROUND OF THE INVENTION

This invention relates generally to the art of dispensing and more particularly to an apparatus for dispensing golf tees.

The term "golf tee" as utilized in this disclosure denotes the device commonly utilized by golfers for holding a golf ball above the ground for striking with a golf club. There is some variation in golf tee designs; but generally, however, golf tees are fabricated from wood or plastic and comprise an elongated body that is symmetrical about a longitudinal axis and which is provided with a relatively sharp point at one end and an enlarged head with a recess at the other end. Golf tees are generally about one and one-half to two inches in length and approximately three-eighths of an inch in diameter at the head.

Golf tees have traditionally been carried by golfers within garment pockets and because of the frequent breakage thereof a supply of golf tees must be carried by the golfer during the play of the game. Frequently this supply is carried within garment pockets or stuck within shoe laces or generally placed within a golf bag along with an extra supply of golf balls. All such means are generally awkward and cumbersome and frequently result in some damage to the players' garments.

A variety of devices, however, have been devised in an attempt to overcome the shortcomings discussed above. For example, U.S. Pat. No. 3,891,130 to Brennan discloses a dispensing device in the form of a golf ball wherein tees are generally lodged through what would otherwise be dimples on the golfball surface. The device is provided with a slit opening for removing and replenishing the supply of tees.

U.S. Pat. No. 3,870,300 to Amendola describes a dispensing device which is in effect a cartridge belt having individual compartments for an inventory of tees.

U.S. Pat. No. 2,073,328 describes a unique golf tee wherein the tee is hollow and the tees nest one within the other for nesting within a cylindrical dispensing device.

U.S. Pat. No. 1,852,956 describes a golf club with a dispensing compartment at one end thereof for dispensing and placing golf tees. U.S. Pat. No. 1,709,546 describes a similar club structure but which has individual compartments at the shaft end for storing a plurality of golf tees.

While such devices have improved somewhat upon the haphazard prior art technique of carrying tees within garments and golf bags, there still remains room for considerable improvement in an apparatus for carrying and dispensing golf tees.

SUMMARY OF THE INVENTION

It is this an object of this invention to provide a novel container and apparatus for golf tees.

It is a further object of this invention to provide a simple container and dispenser for golf tees which may be simply attached to a golf bag or cart.

These as well as other objects are accomplished by a dispenser for golf tees formed of a hollow tube having a central opening in the center thereof with a diameter larger than the diameter of the head of a golf tee but less than the length of a tee. One end of the tube has an elastomeric nipple attached which defines an orifice smaller than the head of a golf tee but larger than the pointed end of the tee for dispensing golf tees through. The tube also defines an opening for the loading of golf tees into the cylindrical opening.

DETAILED DESCRIPTION

In accordance with invention, it has been found that a simple and effective apparatus may be provided for containing and dispensing golf tees to greatly simplify that effort for the golfer. The apparatus of this invention may be conveniently attached to a golf cart or attached to a golf bag for use during play. Various other advantages and features will become apparent from a reading of the following description given with reference to the various figures of drawing.

Figure 1:
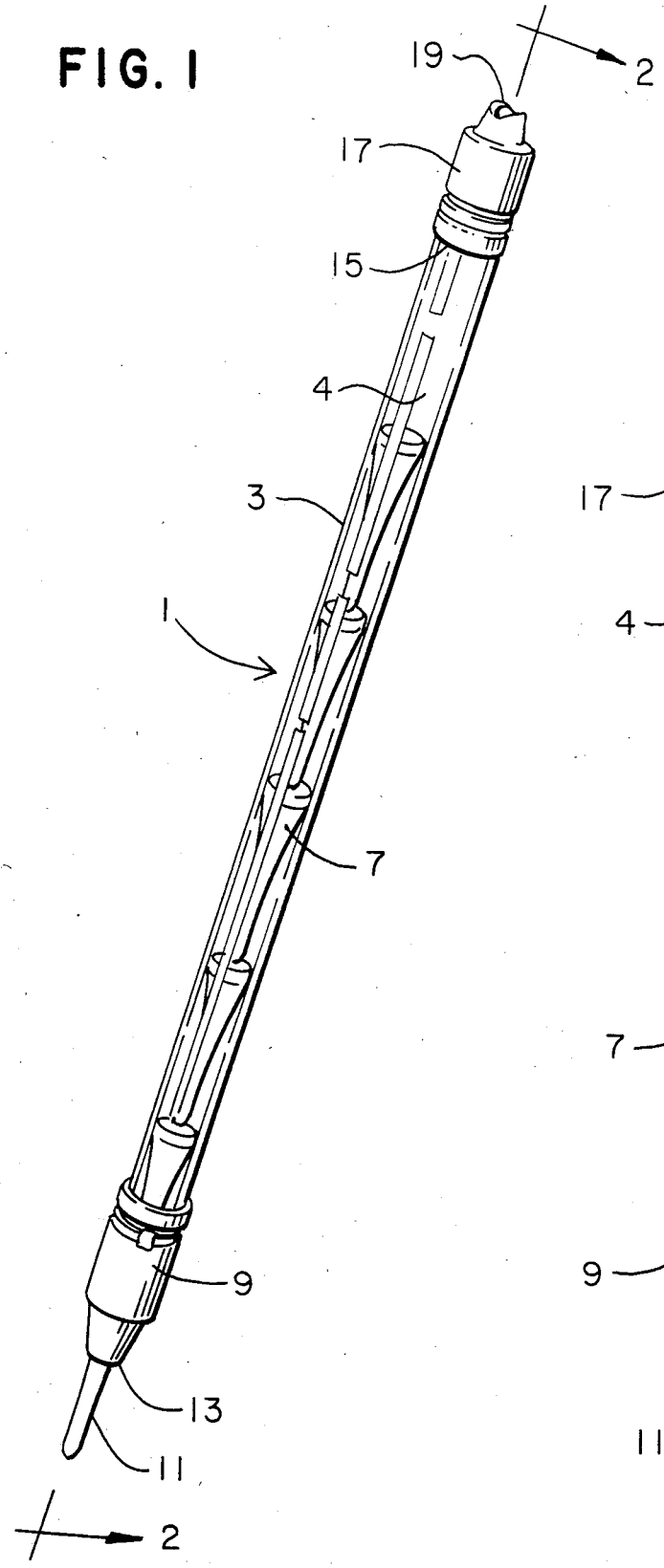
FIG. 1 of the drawings illustrates in perspective view an apparatus in accordance with this invention.

FIG. 1 of the drawings illustrates the container and dispenser 1 in accordance with this invention. The dispenser comprises a tube 3 having a cylindrical opening through the center thereof for containing a plurality of tees 7. Tube 3 is preferably formed of a transparent material such as lucite or polycarbonate.

At one end of tube 3 is an elastomeric nipple 9 through which a tee 11 is illustrated in the dispensing position. It will be noted that the elastomeric nipple 9 defines dispensing opening 13 to have a diameter which is greater than that of the pointed end of tee 11 but which is of a lesser diameter than the head of the tee 11. Tee 11 must be forceably removed from dispensing nipple 9 but will not otherwise be removed. Orifice 13 communicates with the cylindrical opening 4 of tube 3 in order to cooperatively facilitate gravity feeding of the plurality of tee 7 to this dispensing position illustrated as being occupied by tee 11.

Figure 2:
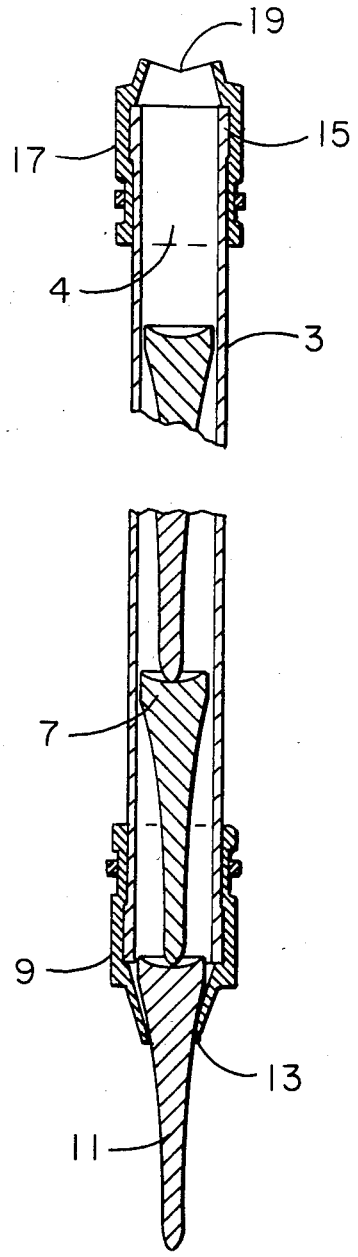
FIG. 2 of the drawings is a view along the line 2—2 of FIG. 1.

FIG. 2 of the drawings better illustrates the tee 11 in the dispensing position and the cooperation between the funnel form of nipple 9 leading to opening 13. It should be noted that the diameter of tube 3 is greater than the diameter of the head of a golf tee but is of a lesser diameter than the length of a tee in order to assure longitudinal orientation of the tees within the container. An inside diameter of 17/32 of an inch has been found to provide surprisingly superior performance.

As illustrated in FIGS. 1 and 2, the other end 15 of tube 3 from dispensing nipple 9 is utilized in this embodiment for loading tees 7 into the cylinder 4. Preferably this loading opening is provided with an elastomeric cover such as 17 having an orifice 19 therethrough for finger loading of tees into the cylinder 4. Force is thus required to place tees through the cover 19 but once tees are lodged within the cylinder 4, they can only be removed through the opening 13 and the dispensing nipple 9.

Figure 3:
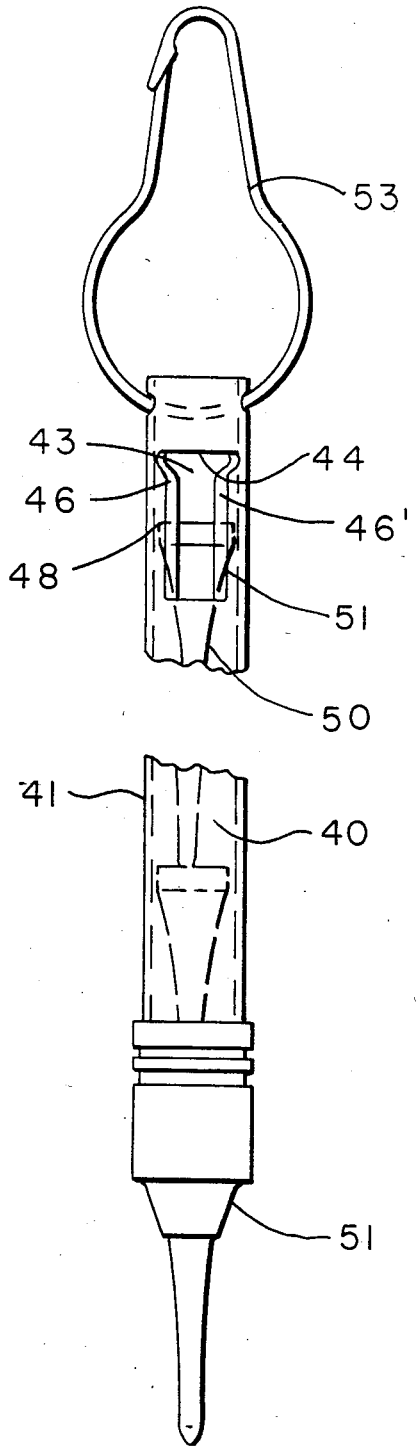
FIG. 3 of the drawings illustrates in perspective view yet another embodiment of this invention.

A preferred embodiment of the invention is illustrated in FIG. 3 of the drawings wherein a somewhat shorter cylinder 40 is defined by tube 41. The loading opening 43 of this embodiment is generally a triangular opening 43 through the wall of tube 41. The triangular opening 43 is oriented such that tees may be placed through the triangular opening and fall by gravity toward nipple 51 which is similar to the nipple 9 as illustrated in the embodiment of FIGS. 1 and 2. The length of opening 43 is less than the length of a golf tee which facilitates loading through the opening 43 but which prevents any unintentional dislodgement therethrough due to the discrepancy between the length of the triangular opening 43 and the length of the golf tee.

The opening 43 is defined by an upper surface 44 and tapering side walls 46 and 46'. The spacial relationship between upper surface 44 and tapering side walls 46 and 46' is such that the defined space is slightly less than distance between the upper surface 48 of tee 50 and the neck 52 thereof. This necessitates the use of force to snap a tee into the cylinder 40. This assures a positive loading and prevents dislodgement through opening 43.

Additionally illustrated in the FIG. 3 embodiment is a circular ring 53 which may be utilized to hang the dispenser in a convenient location upon a golf bag. Ring 53 may be conveniently attached to the umbrella ring or straping of a golf bag. As an alternative, the dispenser of this invention may be simply strapped in a verticle orientation to portions, such as a roof support, of a golf cart utilizing conventional plastic ties.

It is thus seen that the apparatus of this invention provides a novel container and dispenser for golf tees. It is further seen that the dispenser overcomes significant shortcomings of the prior art and may be conveniently mounted upon a golf cart or upon a golf bag. As many variations will become apparent from a reading of the above specification which is exemplary in nature such variations are included within the spirit and scope of this invention as defined by the following appended claims.

That which is claimed is:

1. A container and dispenser for golf tees comprising:

a tube having a cylindrical opening through the center thereof, said cylindrical opening having a diameter larger than the diameter of the head of a golf tee and less than the length of a golf tee;

an elastomeric nipple attached to one end of said tube, said nipple defining an orifice smaller than the head of a golf tee and larger than the pointed end of a tee, said orifice communicating with said cylindrical opening; said tube defining an opening for loading of golf tees into said cylindrical opening;

said opening for loading golf tees being a generally triangular opening through said tube and defined by the sidewalls thereof and having an upper surface and tapering sidewalls to define said opening, said upper surface and said tapering sidewalls of said opening defining a space therethrough which is less than the special relationship defined by the upper surface of a tee and the neck portion thereof whereby a tee is forcefully loaded through said opening.

2. The container and dispenser for golf tees according to claim 1 further comprising a mounting ring attached to said tube at the other end thereof from said dispensing nipple.

* * * * *